US010518969B2

(12) United States Patent
Hindbo

(10) Patent No.: US 10,518,969 B2
(45) Date of Patent: Dec. 31, 2019

(54) CONTAINMENT SYSTEM

(71) Applicant: ThinkTank Products Inc., Olds (CA)

(72) Inventor: Monte W. Hindbo, Olds (CA)

(73) Assignee: ThinkTank Products Inc., Olds (CA)

( * ) Notice: Subject to any disclaimer, the term of this patent is extended or adjusted under 35 U.S.C. 154(b) by 0 days.

(21) Appl. No.: 15/933,046

(22) Filed: Mar. 22, 2018

(65) Prior Publication Data

US 2018/0208392 A1 Jul. 26, 2018

Related U.S. Application Data

(60) Division of application No. 14/803,364, filed on Jul. 20, 2015, now Pat. No. 9,957,104, which is a (Continued)

(30) Foreign Application Priority Data

Jun. 12, 2013 (CA) ..... 2818057

(51) Int. Cl.
*B65D 90/04* (2006.01)
*B65D 88/16* (2006.01)
*B65D 90/20* (2006.01)

(52) U.S. Cl.
CPC ..... *B65D 90/046* (2013.01); *B65D 88/16* (2013.01); *B65D 90/205* (2013.01)

(58) Field of Classification Search
CPC .... B65D 90/046; B65D 90/16; B65D 90/205; B65D 88/16
See application file for complete search history.

(56) References Cited

U.S. PATENT DOCUMENTS 2,378,128 A * 6/1945 Cates ..... B65D 90/205 217/3 CB
2,690,778 A * 10/1954 Walsh ..... B65D 88/16 220/216

(Continued)

FOREIGN PATENT DOCUMENTS

CA 2 853 981 A1 12/2014
WO 2013/180838 A2 12/2013

OTHER PUBLICATIONS

International Search Report with Written Opinion dated Aug. 16, 2016, issued in corresponding International Application No. PCT/CA2016/050649, filed Jun. 8, 2016, 7 pages.

(Continued)

*Primary Examiner* — Andrew T Kirsch
*Assistant Examiner* — Don M Anderson
(74) *Attorney, Agent, or Firm* — Christensen O'Connor Johnson Kindness, PLLC

(57) ABSTRACT

A containment system comprising a flexible bladder having at least one opening through which a liquid or other fluid or material can be pumped or transferred into or out of the bladder. The bladder has a contracted and an expanded or semi-expanded state. A support structure surrounds the side surfaces of the bladder and provides lateral support to the bladder when the bladder is in an expanded or semi-expanded state. The support structure comprises a plurality of panels that are seperably connected to one another to form an enclosed walled support structure. The at least one opening in the bladder is operatively connected to a point exterior to the support structure to permit the bladder to be filled or evacuated from a position exterior to the support structure.

2 Claims, 16 Drawing Sheets

Related U.S. Application Data continuation-in-part of application No. 14/303,188, filed on Jun. 12, 2014, now abandoned.

(56) References Cited

U.S. PATENT DOCUMENTS

| | | | | |
|---|---|---|---|---|
| 2,855,966 | A * | 10/1958 | Lewis | B65D 90/205 220/565 |
| 2,915,097 | A * | 12/1959 | Lewis | B65D 90/205 220/565 |
| 4,121,389 | A | 10/1978 | Ptaszek | |
| 6,214,092 | B1 | 4/2001 | Odom et al. | |
| 7,299,513 | B1 | 11/2007 | Barrett et al. | |
| 7,360,784 | B2 | 4/2008 | Stewart et al. | |
| 8,434,638 | B2 | 5/2013 | McKenzie | |
| 2011/0272303 | A1 | 11/2011 | Peterken | |
| 2012/0138630 | A1 | 6/2012 | Kinsey, III et al. | |
| 2013/0186890 | A1 | 7/2013 | Moody et al. | |
| 2013/0319552 | A1 | 12/2013 | Svarczkopf et al. | |
| 2014/0166649 | A1 | 6/2014 | Hoopes et al. | |
| 2015/0008218 | A1 | 1/2015 | Lupul et al. | |
| 2015/0096980 | A1 | 4/2015 | Laing et al. | |
| 2015/0166260 | A1 | 6/2015 | Pham et al. | |

OTHER PUBLICATIONS

Notice of Allowance dated Feb. 14, 2017, issued in corresponding Canadian Application No. 2,897,786, filed Jul. 20, 2015, 1 page.

* cited by examiner

CONTAINMENT SYSTEM

CROSS-REFERENCES TO RELATED APPLICATIONS

This application is a division of U.S. patent application Ser. No. 14/803,364, filed Jul. 20, 2015, which is an Continuation in Part of U.S. patent application Ser. No. 14/303,188, filed Jun. 12, 2014, which claims priority to Canadian Application No. 2818057, filed Jun. 12, 2013, all of which are incorporated herein by reference.

FIELD

There is described a containment system largely developed for use in the oil industry for holding large volumes of water required for a process known as "fracing." It will, however, be appreciated that the system could be used for other applications and to contain other fluids, or materials.

BACKGROUND

Canadian Patent Application No. 2,756,305 (Hindbo) entitled "Modular Enclosure System" describes an enclosure that can be rapidly deployed at remote sites. In the oil industry, liners are supported by the walls of the enclosure for containment. There will now be described an alternative containment system.

SUMMARY

There is provided a containment system which includes at least one flexible balloon bladder. The at least one bladder has at least one opening through which liquids are pumped into or out of the at least one bladder. A support structure surrounds and provides lateral support to the bladder.

The containment system, described above, may overcome the inherent instability of the large bladders by providing a surrounding support structure. The term "large" is a relative term. To provide a better indication as to actual size, a containment system in accordance with one embodiment of the invention could be in the form of a circular support structure with a diameter of 72 feet, a height of 12 feet and a holding capacity of 792,500 gallons. Any of an extremely wide range of other sizes and volumes could be used. It will be appreciated that the support structure need not be circular and could be made multi-sided, most likely square or rectangular.

When considering containment systems, the problem of transport to remote sites must at times be addressed. In embodiments of the invention, for transport, a plurality of panels are transported in a disassembled state and then assembled on site to form the support structure. The bladder may be transported in a folded state on a skid. In one embodiment the skid has sidewalls which enclose the skid to form a shipping container for transport. The sidewalls are movable or removable on site to facilitate access to the bladder. The sidewalls may be hinged to the skid to enable them to be folded down flat.

Ease of access to the contents of the bladder is also of concern for containment systems of the type described. For this purpose in embodiments of the invention, at least one conduit extends externally of the support structure for making a fluid flow connection with the bladder. The at least one conduit may be incorporated into the skid. According to a preferred embodiment, the skid has a first portion and a second portion. The at least one conduit extends through the skid, with a first connection at a first end of the at least one conduit positioned in the first portion and a second connection at a second end of the at least one conduit positioned in the second portion. During installation, the skid is positioned underlying at least one of the plurality of panels of the support structure with the first portion of the skid positioned within the interior of the support structure and the second portion of the skid positioned outside the support structure. This enables the bladder to be connected to the first connection with the second connection being positioned externally of the support structure for making a fluid connection with the bladder.

In an embodiment there is provided a containment system comprising a flexible bladder having at least one opening through which a liquid or other fluid or material can be pumped or otherwise transferred into or out of the bladder, the bladder having a contracted state where the contents of the bladder are substantially evacuated and having an expanded or semi-expanded state where the bladder is filled or partially filled with a liquid or other fluid or material, when the bladder is in said expanded or semi-expanded state the bladder has one or more side surfaces oriented in a generally vertical plane; and a support structure that surrounds the bladder and provides lateral support to the bladder when the bladder is in said expanded or semi-expanded state, the support structure comprising a plurality of panels that are seperably connected to one another to form an enclosed walled support structure, the at least one opening in the bladder operatively connected to a point exterior to the support structure to permit the bladder to be filled or evacuated from a position exterior to the support structure.

There is also provided a containment system comprising a flexible bladder having at least one opening through which a liquid or other fluid or material can be pumped or otherwise transferred into or out of the bladder, the bladder having a contracted state where the contents of the bladder are substantially evacuated and having an expanded state where the bladder is filled or partially filled with the liquid or other fluid or material; a support structure that surrounds the bladder and provides lateral support to the bladder when the bladder is in said expanded state, the support structure comprising a plurality of panels that are separably connected to one another to form an enclosed walled support structure, the support structure including a skid comprising a base member having a first panel member secured thereto, said first panel member having an upper portion and lower portion, said lower portion releasably securable to said base member, said first panel member having a first position wherein it is generally parallel to, and said set-off a predetermined distance from, said base member, said first panel having a second position wherein it is retained generally perpendicular to said base member, said bladder secured to at least the upper portion of said first panel member such that when said first panel member is in said first position said bladder is received between said first panel member and said base member and when said first panel member is in said second position said bladder is deployed and generally hung from said upper portion of said first panel member.

DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
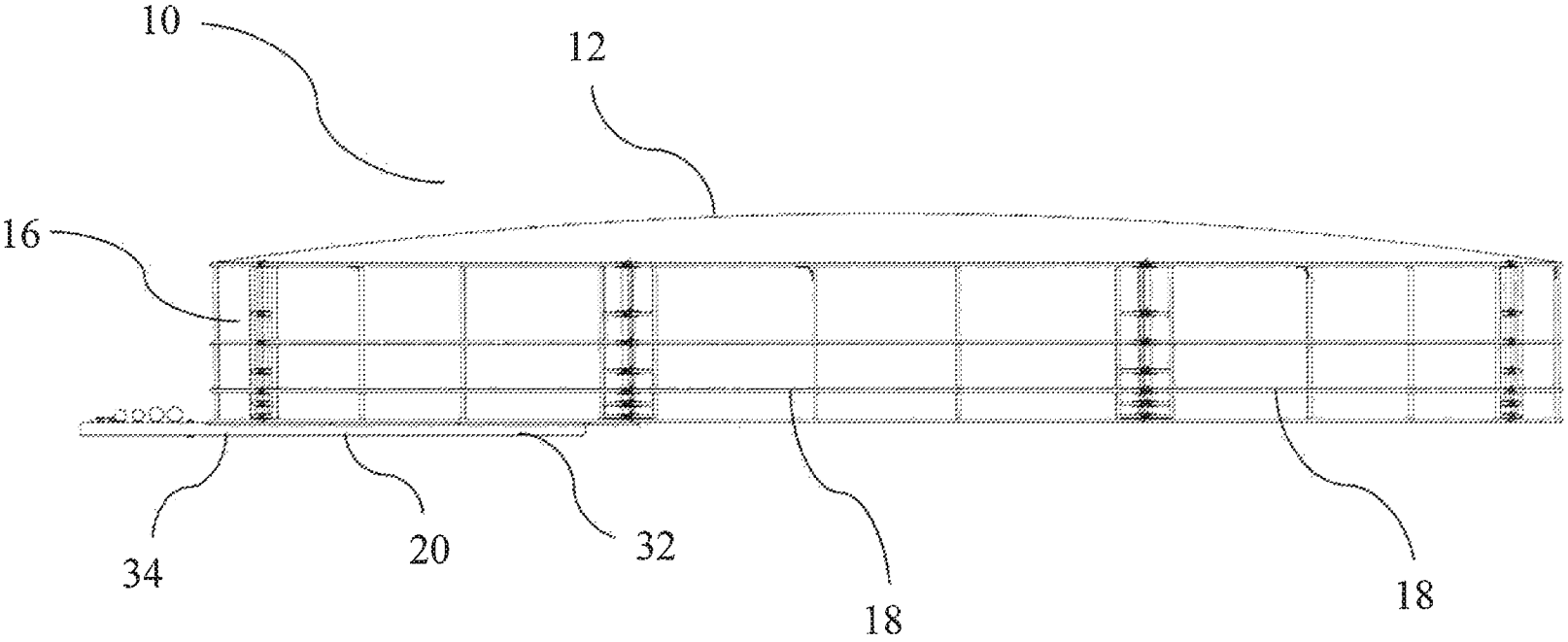
FIG. 1 is a side elevation view of the containment system.

A containment system generally identified by reference numeral 10, will now be described with reference to FIGS. 1 through 6*h*. An alternative embodiment, generally identified by reference numeral 100, will be described with respect to FIG. 7 through FIG. 10.

Referring to FIG. 1, containment system 10 includes a flexible balloon bladder 12. This is a "large" bladder that, in this embodiment, has a holding capacity of at least 300 gallons. Bladder 12 has four openings through which liquids or other fluids or materials are pumped or otherwise transferred into or out of bladder 12. The four opening are not shown in this view and will be hereinafter described. Referring to FIG. 1, a support structure, generally indicated by reference numeral 16, surrounds and provides lateral support to bladder 12. In this embodiment support structure 16 has a diameter of 72 feet, a height of 12 feet and a holding capacity of 792,500 gallons, however, it will be appreciated that other sizes and volumes are possible.

Figure 2:
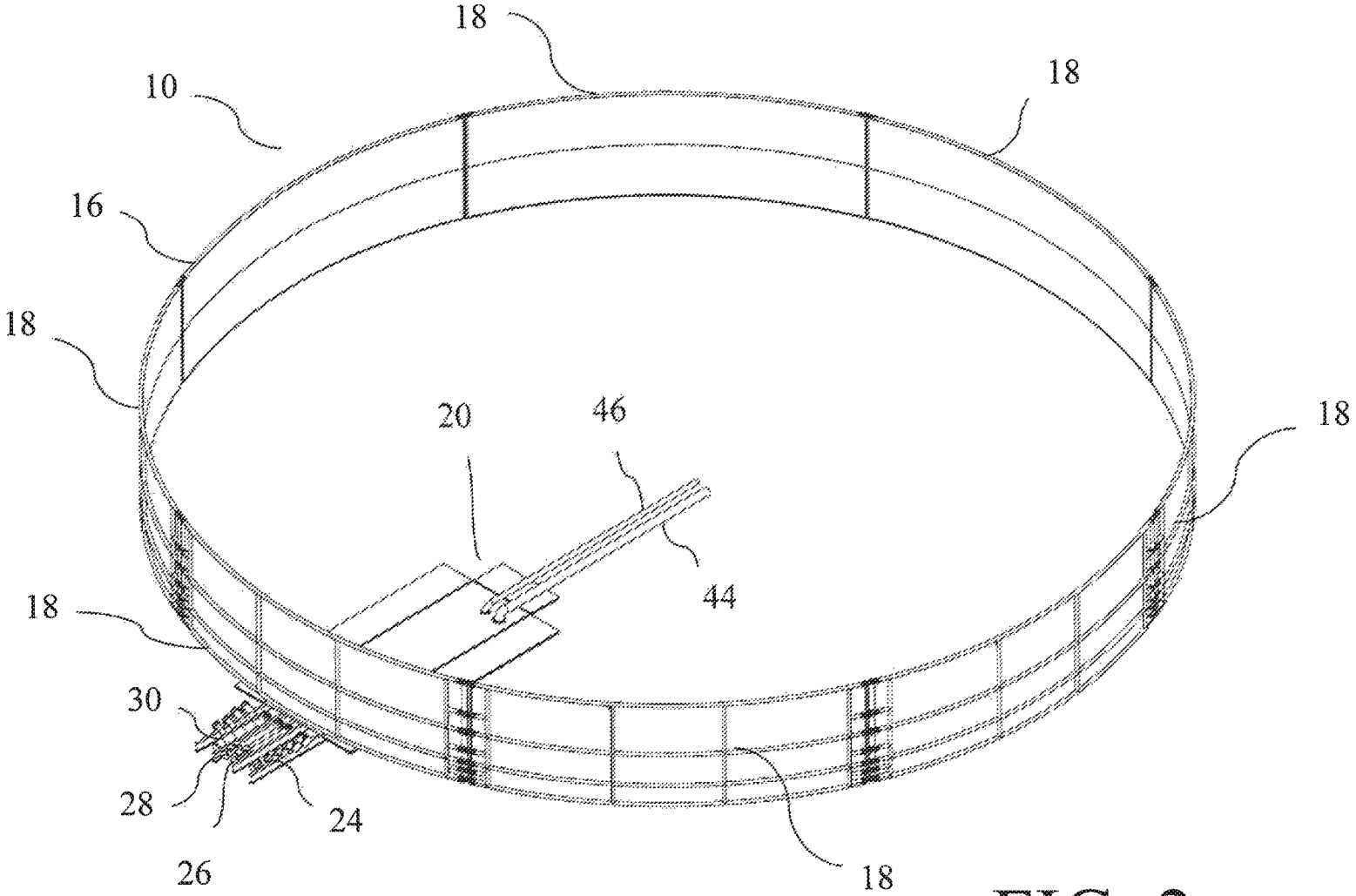
FIG. 2 is a transparent perspective view of the containment system of FIG. 1.
Figure 3:
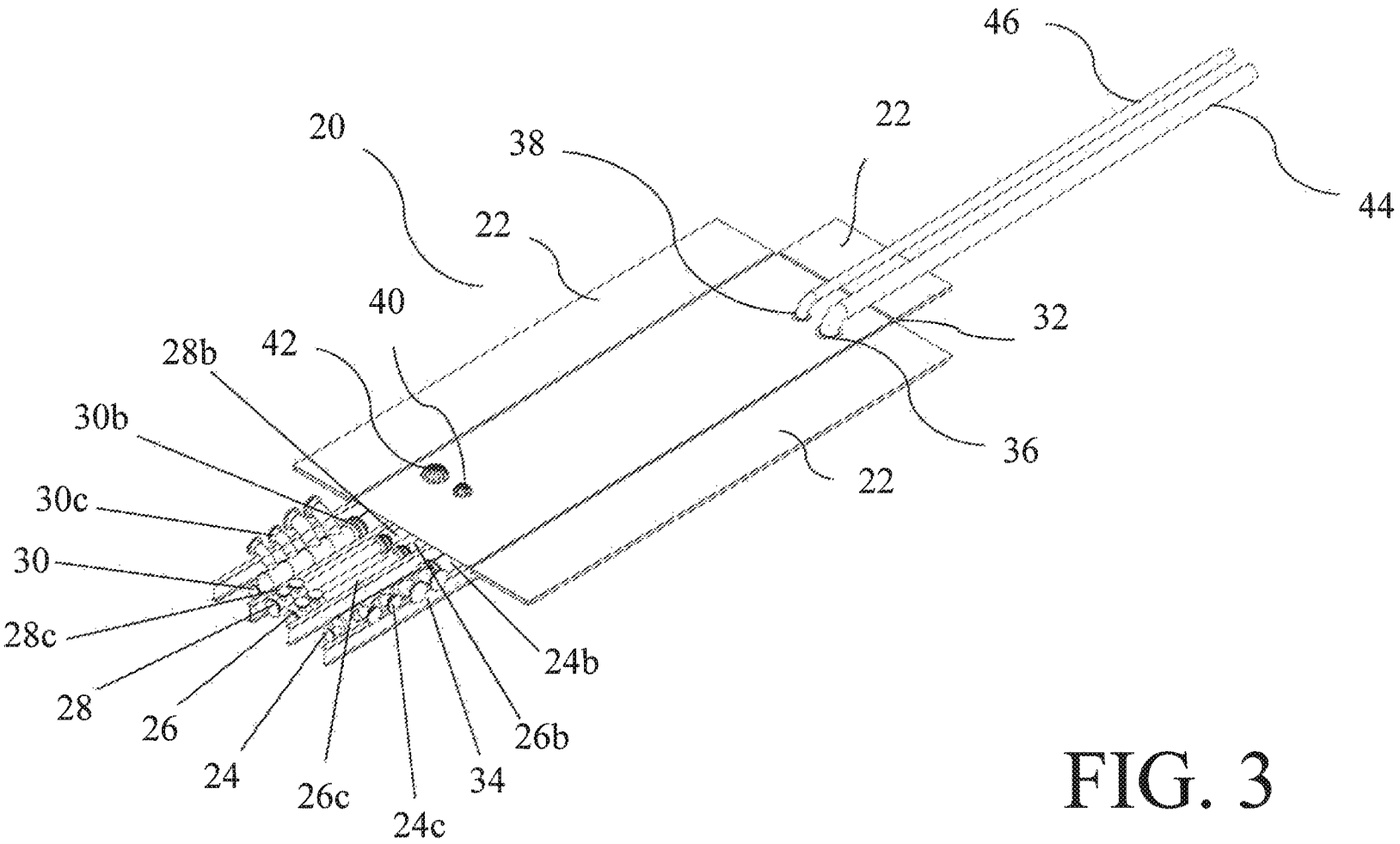
FIG. 3 is a detailed perspective view of a skid structure of the containment system of FIG. 1, with sidewalls lowered.
Figure 5:
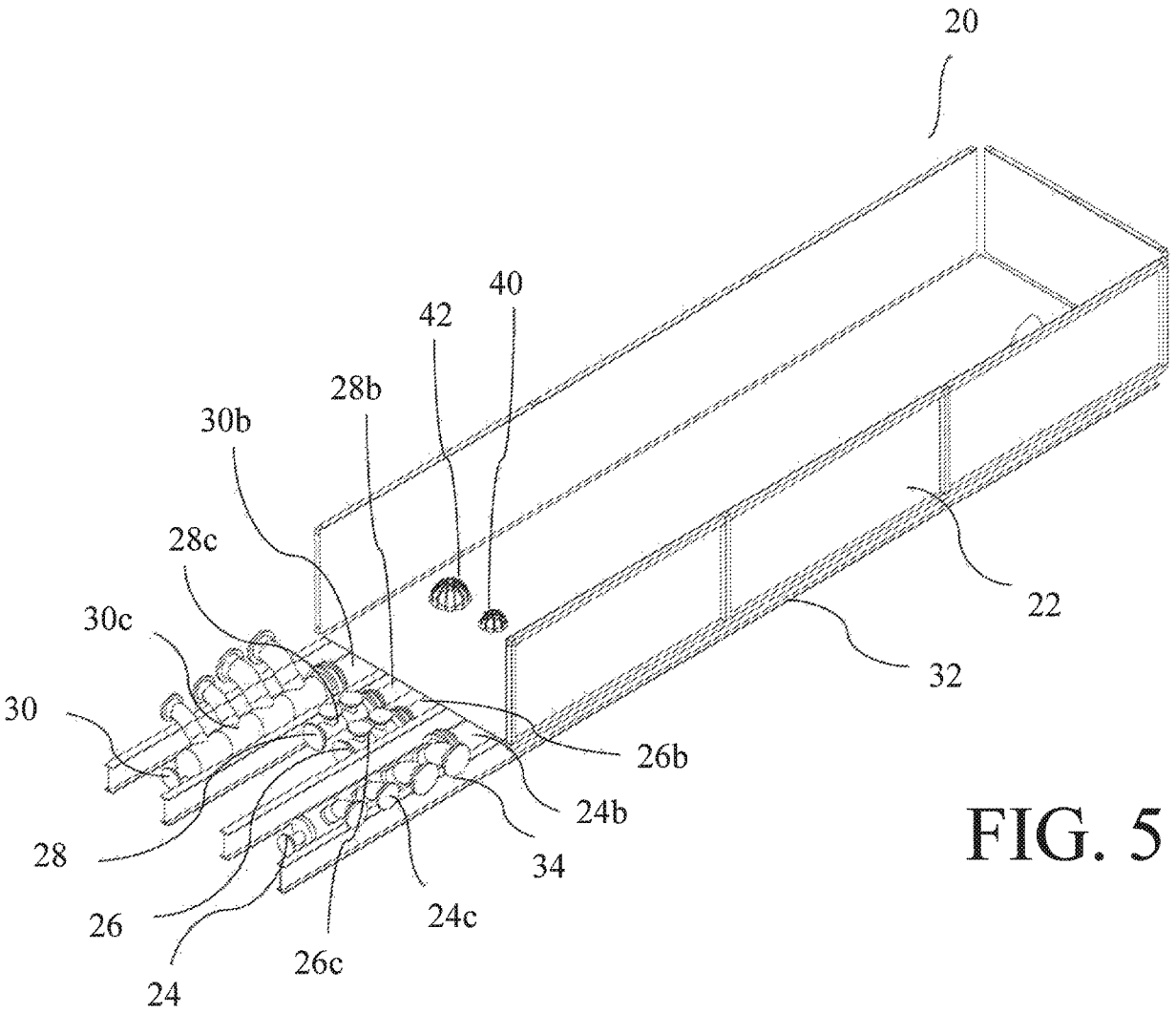
FIG. 5 is a perspective view of the skid structure shown in FIG. 3, with sidewalls raised.
Figure 6A:
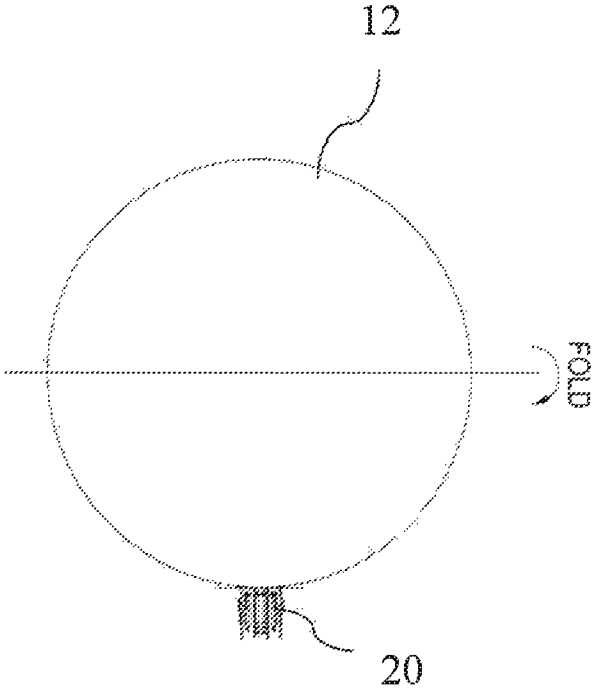
FIGS. 6*a* through 6*h* is a series of top plan views showing sequential folding of a bladder to fit onto the skid illustrated in FIG. 3 through FIG. 5.
Figure 6B:
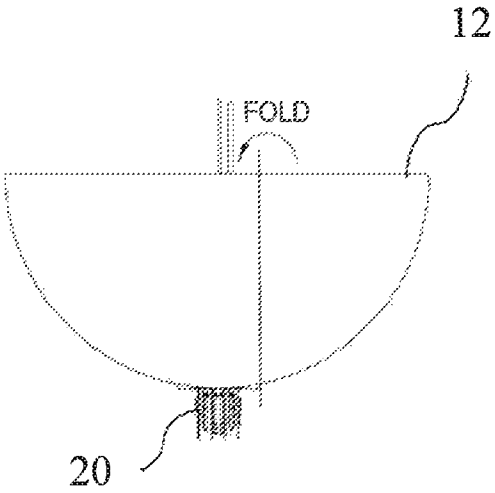
Figure 6C:
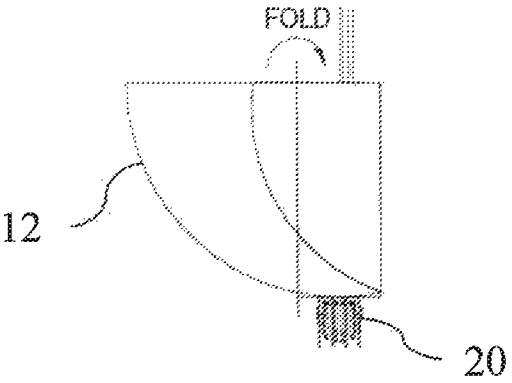
Figure 6F:
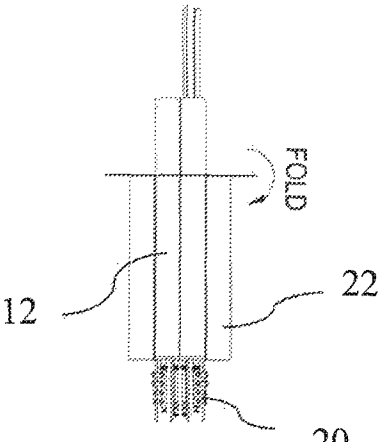
Figure 6E:
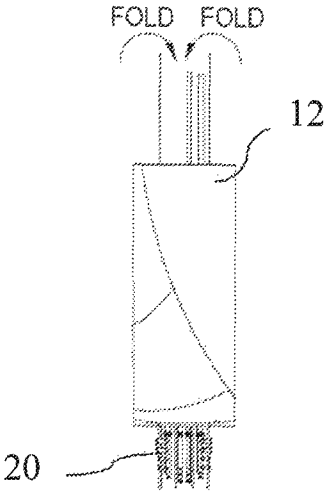
Figure 6D:
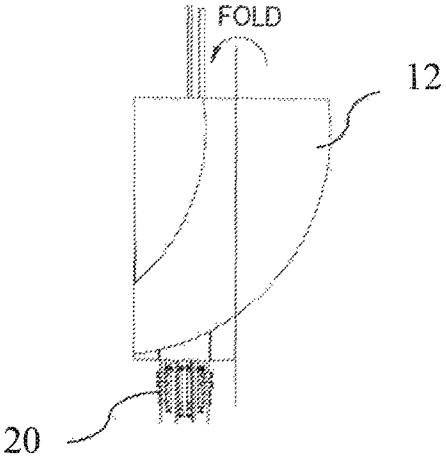
Figure 6H:
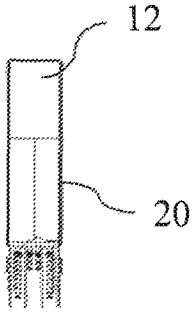
Figure 6G:
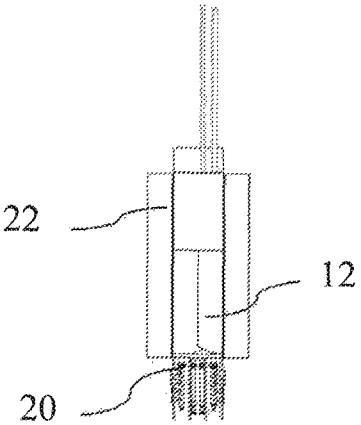

Referring to FIG. 2, support structure 16 was developed with a view to moving containment system 10 to remote sites. For transport, a plurality of panels 18 are transported in a disassembled state and then assembled on site to form support structure 16. The manner of securing panels 18 together to form an enclosure is known and will, therefore, not be further described. Referring to FIG. 6*h*, bladder 12 is transportable in a folded state on a skid 20. Referring to FIG. 5, it is preferred that skid 20 have sidewalls 22 which enclose skid 20 to form a shipping container for transport. Referring to FIGS. 3 and 6*g*, it is also preferred that sidewalls 22 be movable or removable on site to facilitate access to bladder 12.

In the illustrated embodiment, sidewalls 22 are hinged to skid 20 and can simply be folded down flat.

Figure 4:
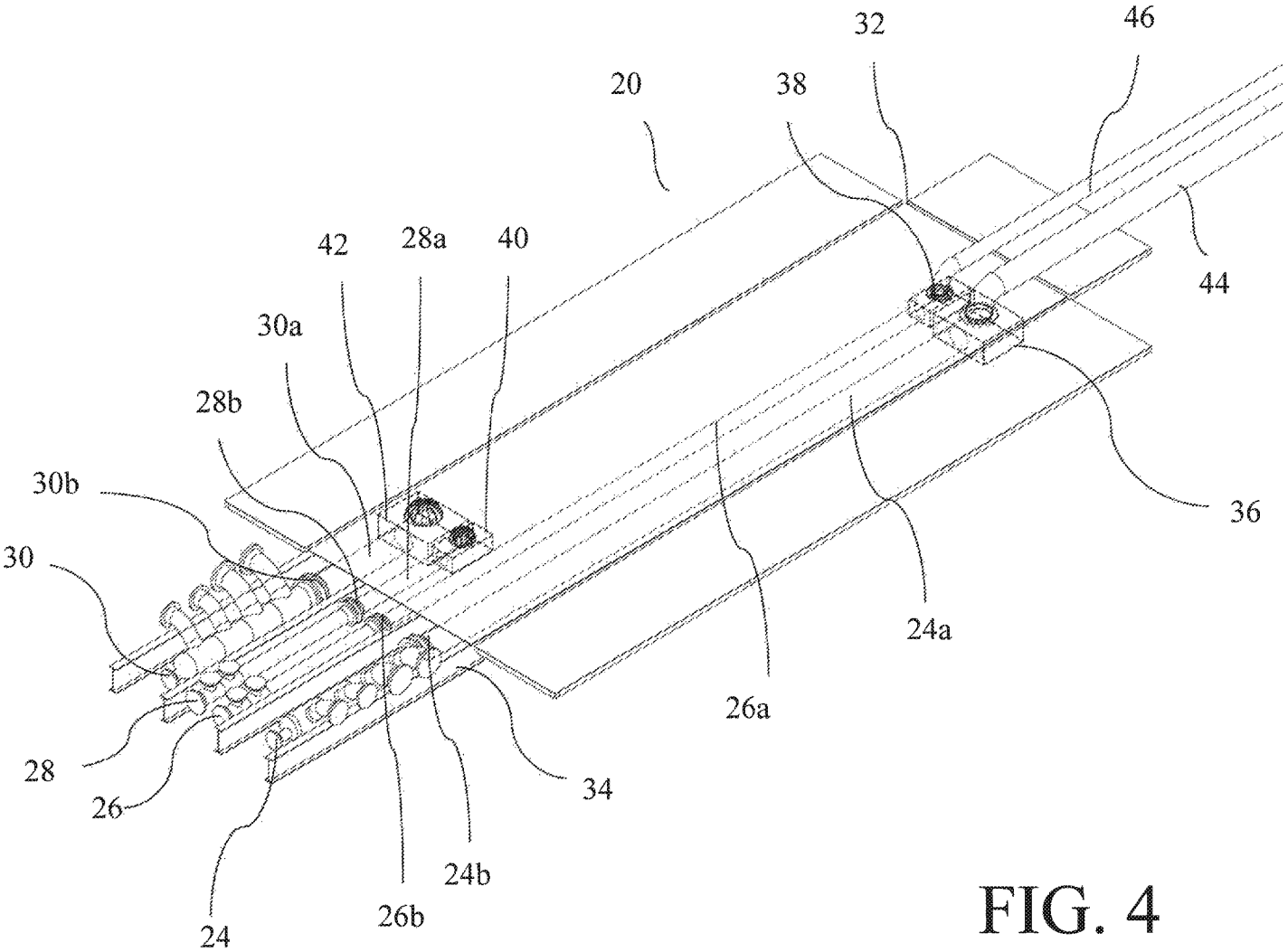
FIG. 4 is a partially transparent perspective view of the skid structure of FIG. 3.
Figure 4A:
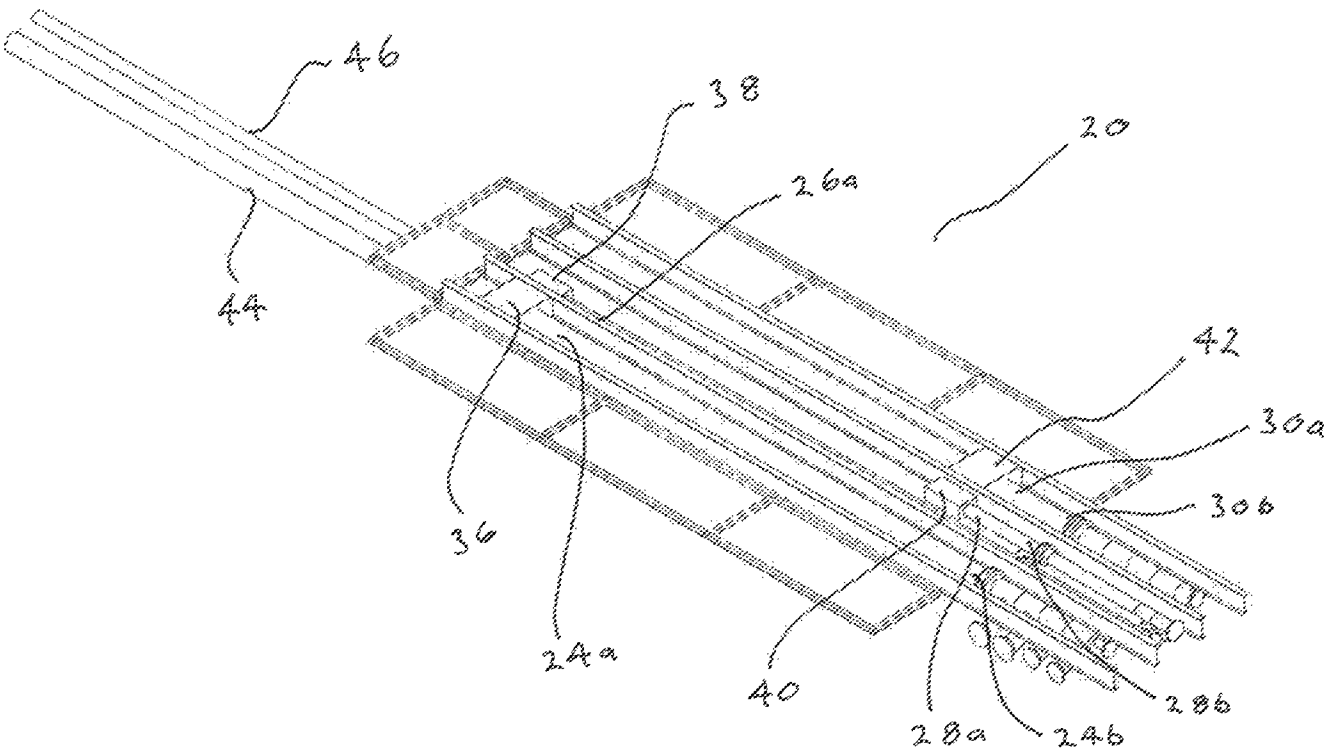
FIG. 4A is a bottom view of the skid structure shown in FIG. 4.

Referring to FIG. 2, conduit 24, 26, 28, and 30 extend externally of support structure 16 for the purpose of making a fluid flow connection with bladder 12. Referring to FIG. 3 and FIG. 5, with skid 20 being used to transport bladder 12, it was realized that conduit 24, 26, 28 and 30 could be incorporated into skid 20. Although skid 20 is illustrated in FIG. 3 and FIG. 5 without bladder 12 being shown, it must be understood that it is intended that bladder be secured with adhesive (or through any one of a variety or clamping means or mechanisms) to skid 20, so it is not removable. Referring to FIG. 4, skid 20 has a first portion 32 to which a portion of bladder 12 is secured and a second portion 34 which does not have any portion of bladder 12 secured to it. Each of conduit 24, 26, 28, and 30 has a first end 24*a*, 26*a*, 28*a* and 30*a* and a second end 24*b*, 26*b*, 28*b* and 30*b*. Each of conduits 24, 26, 28 and 30 extend through skid 20. Bladder 12 has four openings through which fluids can pass, identified by first connection box 36, second connection box 38, third connection box 40 and fourth connection box 42. First connection box 36 connects first end 24*a* of conduit 24 with bladder 12 and has a first extension line 44 that extends into bladder 12. Second connection box 38 connects first end 26*a* of conduit 26 with bladder 12 and has a second extension line 46 that extends into bladder 12. Extension lines 44 and 46 are preferably flexible conduits positioned within bladder 12. Third connection box 40 connects first end 28*a* of conduit 28 with bladder 12. Fourth connection box 42 connects first end 30 of conduit 30 with bladder 12. Referring to FIG. 3 and FIG. 5, each of second ends 24*b*, 26*b*, 28*b*, and 30*b* of conduit 24, 26, 28, and 30 are attached to connection manifolds 24*c*, 26*c*, 28*c*, and 30*c*, respectively. Referring to FIG. 4, first ends 24*a*, 26*a*, 28*a*, and 30*a* of each conduit 24, 26, 28, and 30 are positioned in first portion 32 of skid 20. Second ends 24*b*, 26*b*, 28*b*, and 30*b* of each conduit 24, 26, 28, and 30 are positioned in second portion 34 of skid 20. Referring to FIG. 2, during installation, skid 20 is positioned underlying one of panels 18 of support structure 16 with first portion 32 of skid 20 positioned within the enclosure defined by support structure 16 and second portion 34 of skid 20 positioned outside enclosure defined by support structure 16. This enables bladder 12 to be connected to connection boxes 36, 38, 40 and 42 with connection manifolds 24*c*, 26*c*, 28*c*, and 30*c* being positioned externally of support structure 16 to facilitate making fluid connections with bladder 12.

The manner of installation and operation of containment system 10 will now be described. Referring to FIG. 6*h*, skid 20 is transported to a remote site with bladder 12 secured in position and folded. During transport, sidewalls 22 of skid 20 are up as shown in FIG. 5. Referring to FIG. 6*g*, sidewalls 22 are lowered to provide access to bladder 12 for the purpose of unfolding it, as shown in FIG. 3. First extension line 44 is connected to first connection box 36 and second extension line 46 is connected to second connection box 38. Referring to FIG. 6*f*, the unfolding of bladder 12 then commences as shown sequentially in FIG. 6*e*, FIG. 6*d*, FIG. 6*c*, FIG. 6*b*, and lastly, FIG. 6*a*. Referring to FIG. 2, panels 18 are assembled around bladder 12, with skid 20 positioned underlying one of panels 18 of support structure 16 with first portion 32 of skid 20 to which bladder 12 is attached positioned within the enclosure defined by support structure 16 and second portion 34 of skid 20 positioned outside enclosure defined by support structure 16. Connections are then made to connection manifolds 24*c*, 26*c*, 28*c* and 30*c*. Bladder 12 is then filled or partially filled with the material of choice (which may be a solid, liquid or gas). It will be appreciated that depending on the particular application, the bladder could be filled with any of a very wide variety of different materials. When utilized in the oil industry, bladder 12 could be used to contain water, oil, drilling mud, fracking sand, fracking fluid, etc. In other applications other materials could be contained, including, but not limited to, industrial fluids, liquid or dry form chemicals, drinking or industrial water, and food and agricultural products. When filled or partially filled, the bladder is supported by support structure 16. When the need for containment system 10 has passed its contents are removed from bladder 12 and panels 18 of support structure 16 are disassembled. Bladder 12 is then folded back onto skid 20 as shown in the sequential folding illustrated in FIG. 6*a*, FIG. 6*b*, FIG. 6*c*, FIG. 6*d*, FIG. 6*f*, FIG. 6*g*, and lastly, FIG. 6*h*. The manner of installation and operation of containment system 10 will now be described. Although the preferred shape for the support structure is generally circular, it will be appreciated that the support structure need not be circular and could also be a multi-sided closed polygonal shape, (most commonly square or rectangular) or other shaped enclosed walled structure to support the sides of the bladder. Although a single bladder is illustrated within the enclosure, it will also be appreciated that there could be two or more bladders that press against each other and receive support from a common support structure. Although it is envisage that the support structure is a plurality of panels that can be disassembled for transport, the support structure could be a fixed structure that is not intended to be moved. In a fixed installation, all or a portion of the support structure could be provided by earth works.

Figure 7:
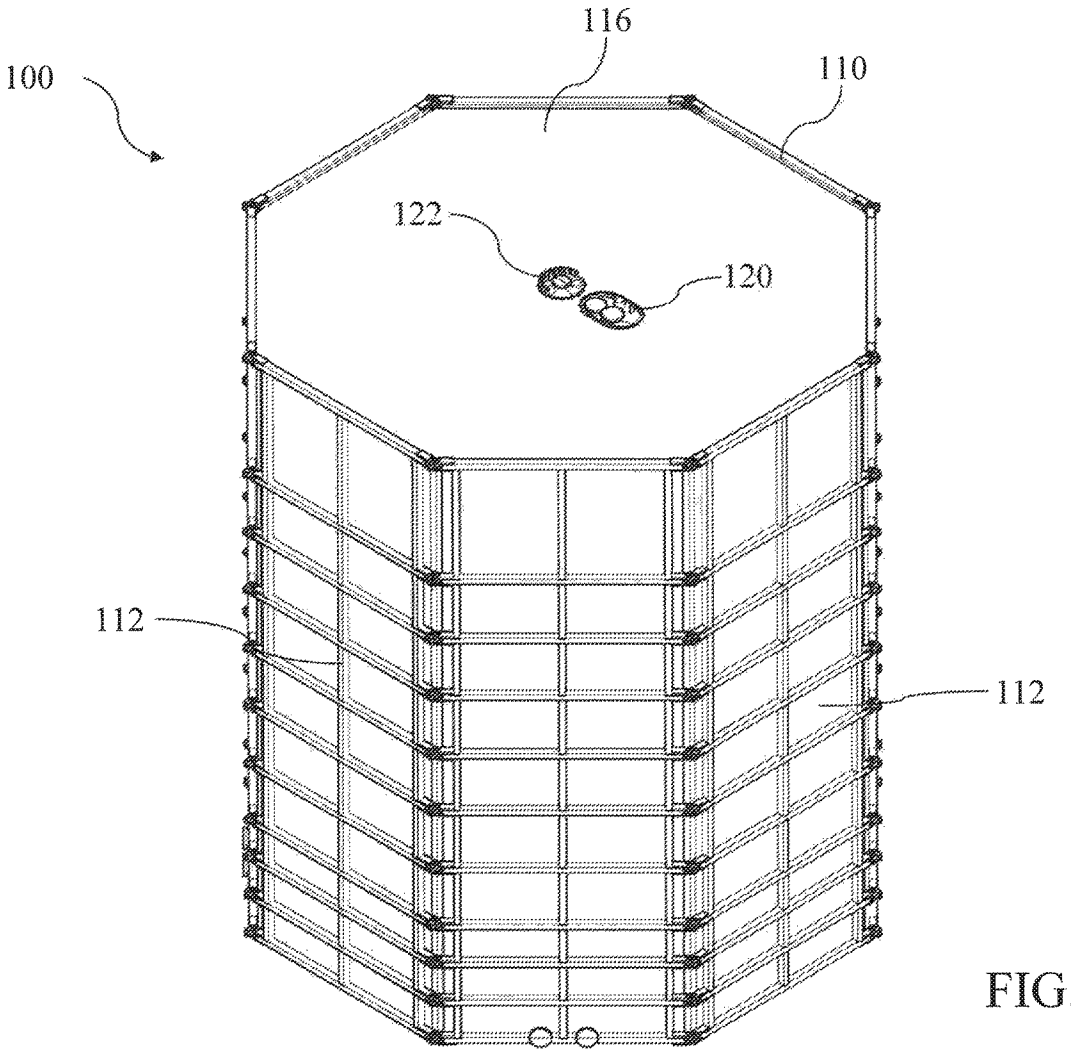
FIG. 7 is a perspective view of an alternative embodiment of a containment system.
Figure 8:
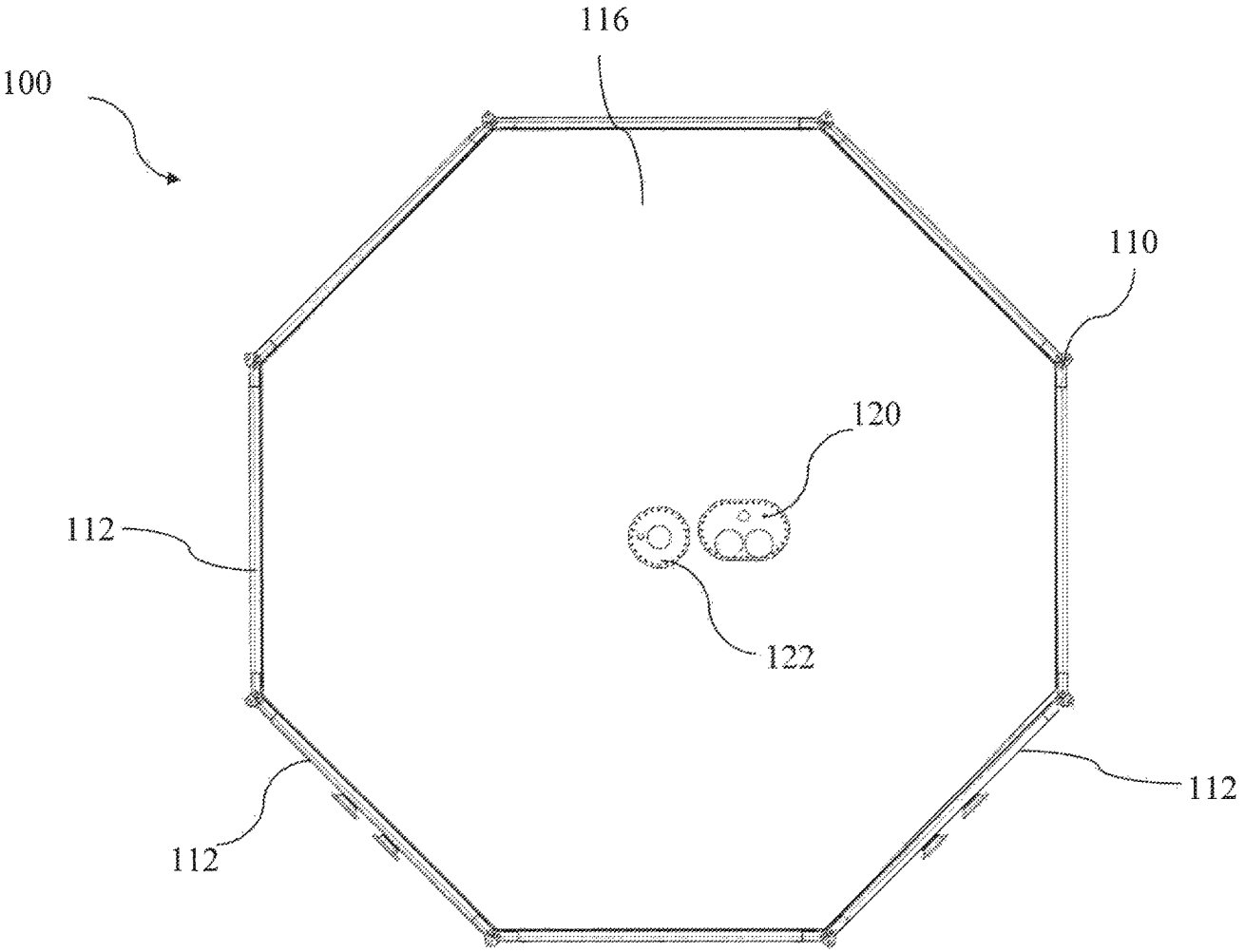
FIG. 8 is a top plan view of the containment system of FIG. 7.
Figure 9:
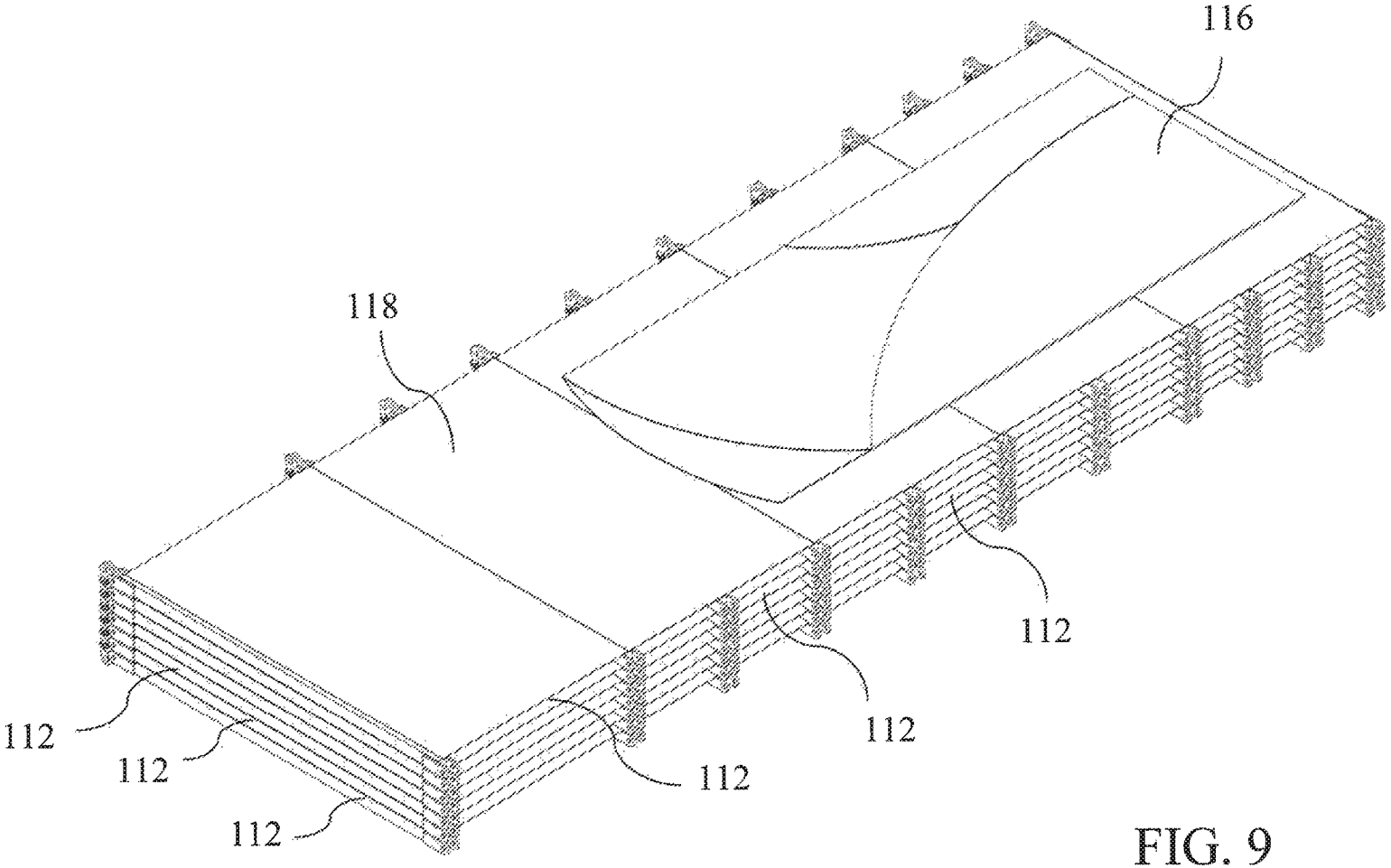
FIG. 9 is a perspective view of panels of the containment system of FIG. 7, prepared for transport.
Figure 10:
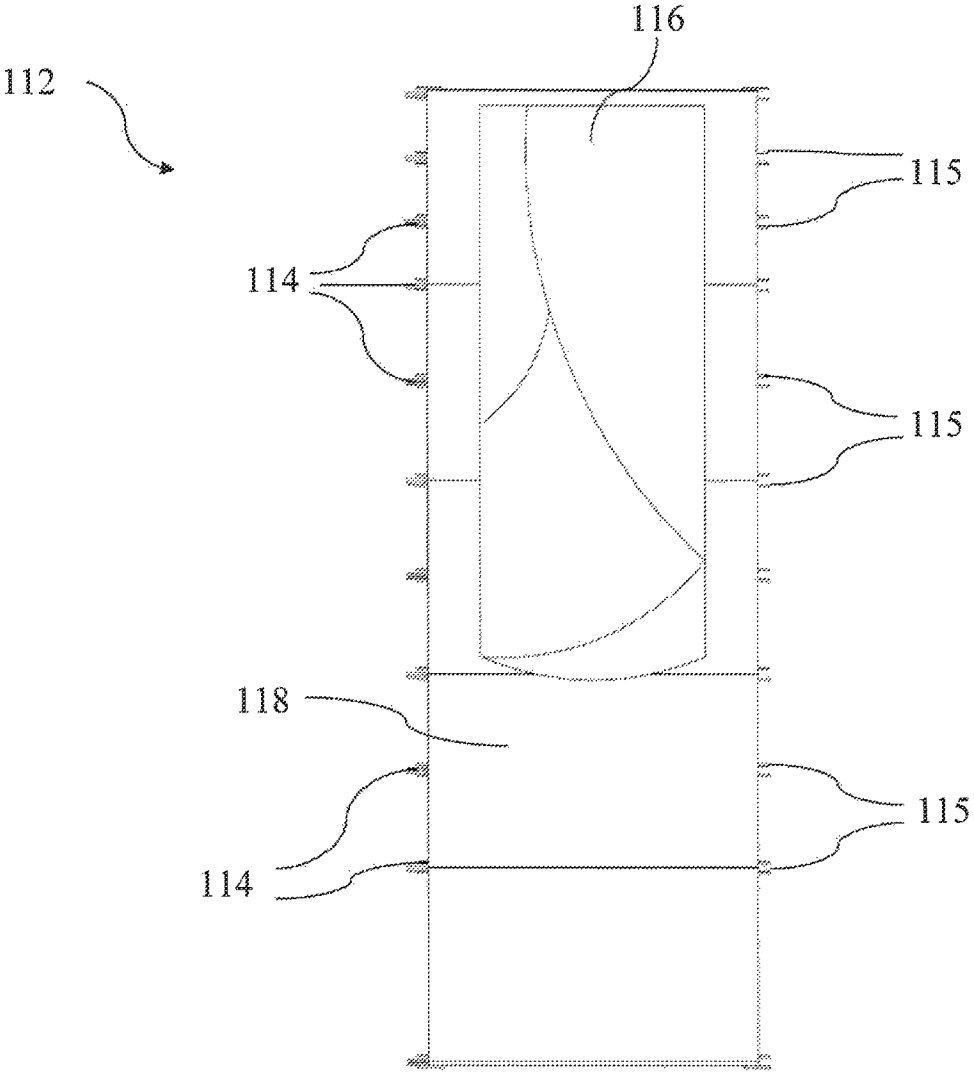
FIG. 10 is a front elevation view of a panel of the containment system of FIG. 7, to which a bladder is adhered for the purpose of ease of transport and ease of deployment.
Figure 11:
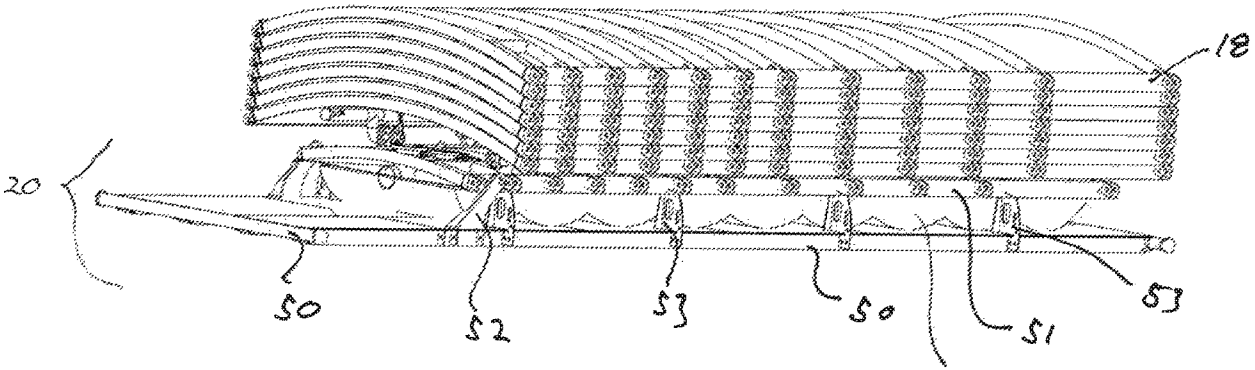
FIG. 11 is a side perspective view of an alternate embodiment of the containment system wherein the major components have been assembled on a skid for transport or prior to assembly.
Figure 13:
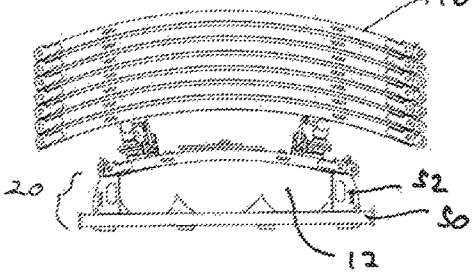
FIG. 13 is a right end view of the embodiment shown in FIG. 11.
Figure 12:
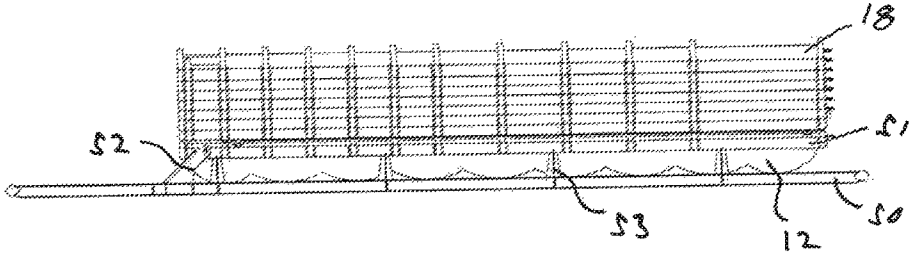
FIG. 12 is a side elevational view of the embodiment shown in FIG. 11.

This could involve mounding up the earth, excavating into the earth or taking advantage of naturally occurring topographical features. Although four openings into the bladder have been illustrated and described, it will be appreciated that the number of openings selected will be to suit the intended application. The bladder can be made of any suitable material that can be expanded and is compatible with the liquid or other fluid to be contained. In an alternate embodiment, the bladder could be filled with a solid or semi-solid material, or could be filled with a fluid having a high solid content. Referring to FIGS. 7 through 10, containment system 100 is a multi-sided body 110 consisting of a plurality of panels 112. Referring to FIG. 9, panels 112 are stacked for transport, with one of panels 112, identified by reference numeral 118, serving as a support skid for bladder 116. Bladder 116 is secured by adhesive or any one of a variety of mechanical means to skid 118 and is transported in a folded condition. Referring to FIG. 7 and FIG. 8, when panels 112 are delivered on site, panels 112 are connected to form body 110. There are a plurality of connectors known in the art for connecting panels 112, so the panel connectors will not be described in detail. Referring to FIG. 10, the panel connectors illustrated are simply tongues 114 protruding from one side of panel 112 and parallel plates 115 protruding from another side of panel 112. Each of tongues 114 are inserted between one of the pairs of parallel plates 115 and a bolt dropped into aligned apertures to prevent tongues 114 from being withdrawn. The panel connectors do not need to be capable of retaining liquid, as bladder 116 will retain liquid. Referring to FIG. 10, one of panels 112 used to form body 110 is skid 118 to which bladder 116 is secured. Bladder 116 is then unfolded in preparation for use. Once substantially unfolded, continued deployment can be assisted by gas (for example, air or nitrogen) or by liquids. There can be a single bladder 116 or two bladders confined by body 110 and each other. It will be appreciated that bladder 116 will have fittings of various kinds, such as hose connection fittings 120 to provide for hose connection and vent fittings 122 to provide for venting. Other fittings may be required, depending upon the installation. FIGS. 11 through 21 show an alternate embodiment of the containment system. With reference to FIGS. 11 through 13, there is shown the primary components of an embodiment of the containment system in a stacked form, as they would be prior to (or following) assembly of the containment system or when in transport. Here, a plurality of panels 18 are shown stacked upon a skid 20. Skid 20 is comprised of a base 50 having hingedly secured to it a first panel member 51 through the use of a pair of hinges 52. In the embodiment depicted first panel member 51 has been rotated such that it is horizontal or generally parallel to base 50, resting on a plurality of removable support arms 53. As will become more apparent from a full understanding of this embodiment, support arms 53 set-off first panel member a predetermined distance from base member 50 in order to provide a volume that can be accommodated by bladder 12. A plurality of additional panels 18 are stacked over first panel member 51, with their weight also borne by support arms 53. When assembled in this fashion, the primary components of the containment system can be strapped or otherwise clamped or held together upon skid 20 to allow for easy transportation from site to site, and to also allow for easy deployment and assembly.

Figure 16:
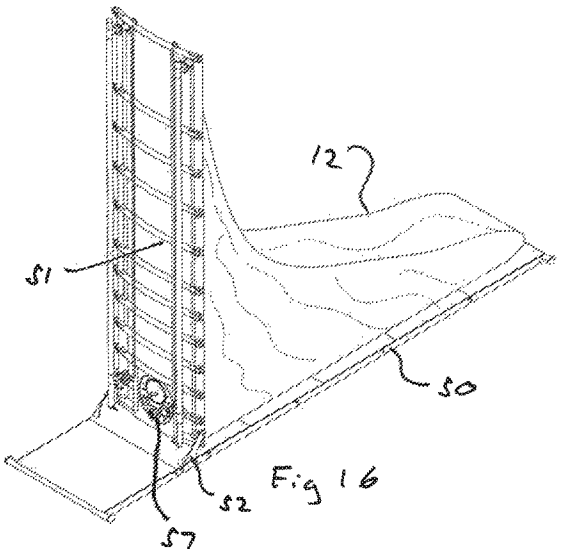
FIG. 16 is a view further to that shown in FIGS. 14 and 15 wherein the panel member is generally perpendicular to the skid.
Figure 17:
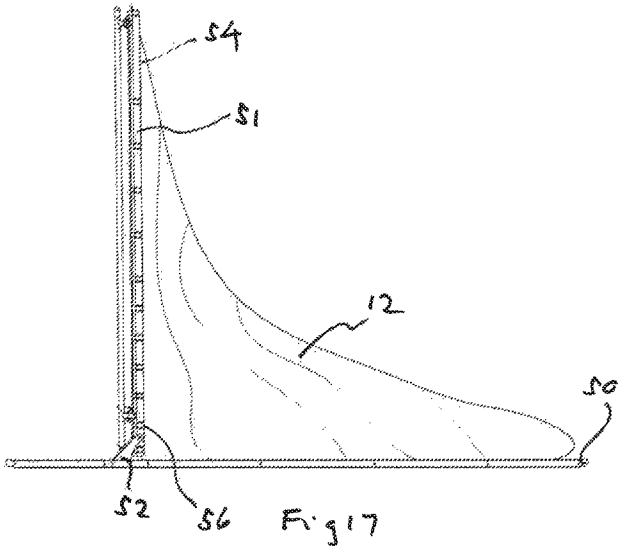
FIG. 17 is a side elevational view of the embodiment shown in FIG. 16.
Figure 14:
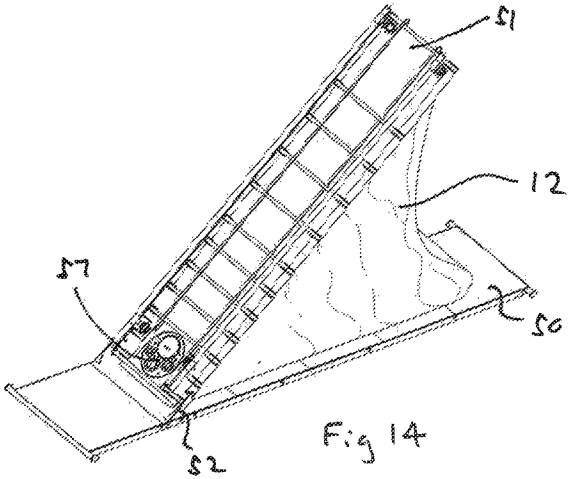
FIG. 14 shows the embodiment of the containment system of FIG. 11 wherein a panel member hingedly secured to the skid is in the process of being erected while at the same time deploying the bladder.
Figure 15:
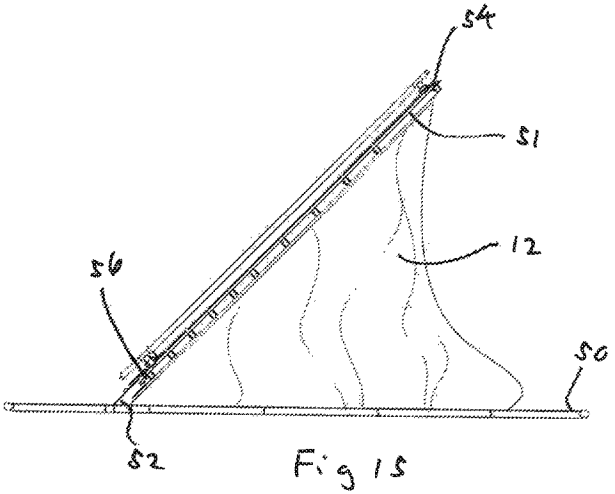
FIG. 15 is a side elevational view of the view shown in FIG. 14.

With reference to FIGS. 14 through 17, in the embodiment shown, bladder 12 is secured to at least the upper portion 54 of first panel member 51. In this manner, when panels 18 are removed from their position stacked upon skid 20 and first panel 51 rotated to a generally vertical orientation, bladder 12 is unfolded from its position within the stacked skid assembly and generally deployed. In that regard FIGS. 14 and 15 show first panel member 51 partially rotated to its vertical orientation and depict bladder 12 being pulled upwardly from its position on top of base member 50 of skid 20. Similarly, FIGS. 16 and 17 show first panel member 51 in its generally vertical orientation (generally perpendicular to base member 50) with bladder 12 secured to at least the upper portion of the first panel member, hung from the top of first panel member 51, and partially deployed. Once rotated to a generally vertical orientation, a locking mechanism is utilized to secure and retain first panel member 51 at an approximate right angle relative to base member 50. It will be appreciated by one of ordinary skill in the art that a wide variety of different locking or fastening mechanisms could be utilized in that regard. As first panel member 51 is rotated upwardly to its generally vertical orientation (or subsequent to the locking or fixing of the first panel member in its generally vertical orientation), support arms 53 are removed from base member 50 in order to present smooth and clean surface up which bladder 12 can bear when eventually filled with a liquid or other material. In that regard support arms 53 may be releasably secured to base member 50 of skid 20 through a variety of different mechanical means. Alternatively, support arms 53 may be foldable or otherwise rendered non-obstructive to bladder 12 when the containment system is fully assembled and the bladder is filled or partially filled.

It should be noted that although first panel member 51 is shown as hingedly secured to base member 50, the first panel member may be releasably secured to the base member through other mechanical, hydraulic or electro-mechanical means that do not necessarily comprise hinges per se.

Base member 50 is preferably dimensioned such that it has a width generally approximating that of first panel member 51 to present an adequate void between the base member and the first panel member for receipt of bladder 12. Hinges 52 are preferably positioned upon base member 50 such that a portion of the base member extends exterior to the first panel member (i.e. exterior to the containment system when it is assembled) when the first panel member is oriented in a generally vertical plane. As shown particularly in FIGS. 16 and 17, the extension of base member 50 exterior to the containment system and first panel member 51 will assist in stabilizing the structure during its assembly and disassembly, more so than would be the situation if hinges 52 were positioned at the outermost end of base member 50. It will also be appreciated that the degree of set-off provided to first panel member 51 by hinges 52 and support arms 53 may vary depending upon the particular size of bladder 12. That is, it will be appreciated and understood that when first panel member 51 is folded into a parallel relationship relative to base member 50, bladder 12 may be folded and retained within the void created between the first panel member and base member 50 of skid 20. In this manner the bladder is held in position for transport and protected from damage that could occur from contacting panels 18 or other foreign objects.

Once panel member 51 has been rotated and locked in a generally vertical orientation relative to base member 50, the remainder of panels 18 can be secured to one another and/or first panel member 51 in order to create support structure 12. The particular structure of panels 18 and the manner in which adjacent panels are secured together can vary.

Figure 18:
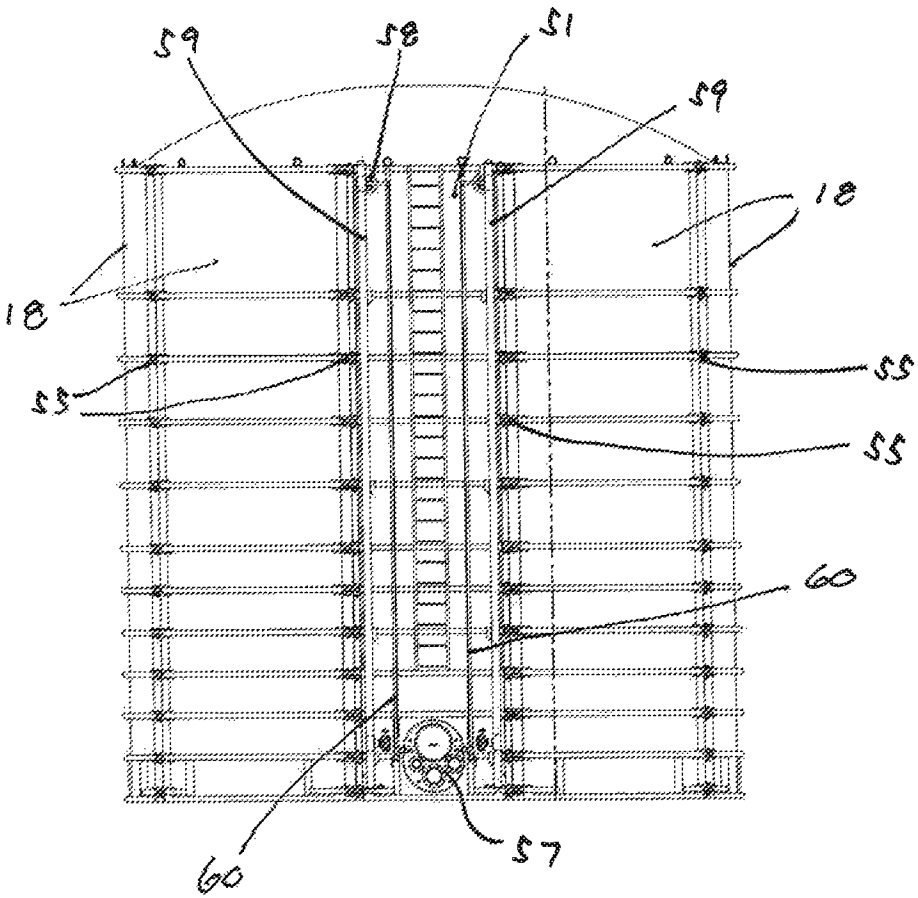
FIG. 18 is a side elevational view of an assembled tank formed using the components of the containment system of FIG. 11.

FIG. 18 shows but one embodiment where adjacent panels are held together through the use of bolts or clamps 55 such that a generally cylindrical support structure is formed. It will, however, be understood that other shapes of support structures could equally be utilized (for example, square, rectangle, octagonal).

Figure 21:
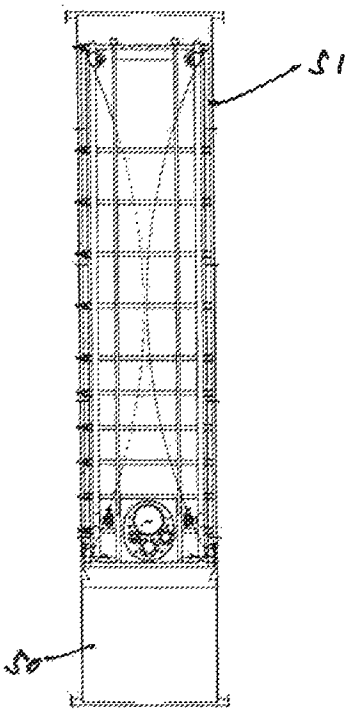
FIG. 21 is a view similar to FIG. 20 wherein the bladder has been fully folded into the skid for transport.
Figure 20:
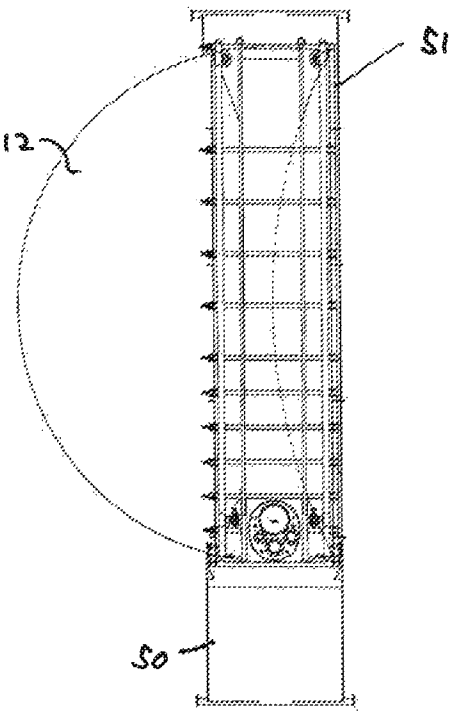
FIG. 20 is a view similar to FIG. 19 wherein the bladder has been partially folded into the skid.
Figure 19:
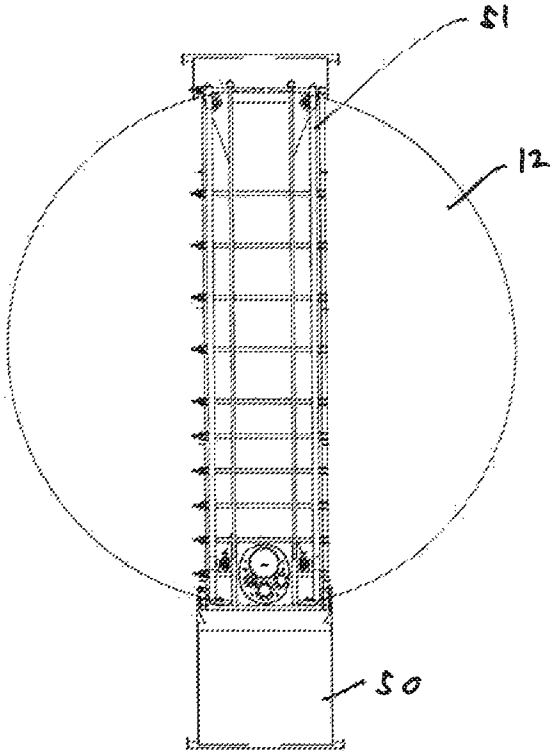
FIG. 19 is a plan view of the embodiment shown in FIG. 16 wherein the panel has been rotated downwardly and is supported on the skid during disassembly of the tank shown in FIG. 18.

When the need for containment system 10 no longer exists, the major components of the embodiment shown in FIGS. 11 through 21 can be readily disassembled and stacked for storage or transport. Doing so merely requires that the panel members be disassembled, and first panel member 51 unlocked from its vertical orientation and rotated downwardly into a position where it is parallel to base member 50 and supported by support arms 53. Either simultaneously or thereafter, bladder 12 can be folded into the void created between the first panel member and the base member to retain and protect the bladder. FIG. 19 shows the general position of the bladder when first panel member 1 has been initially rotated into a parallel configuration with base member 50. FIG. 20 demonstrates the right portion of the bladder having been folded into the void between the first panel member and the base member. FIG. 21 shows both the right and left portions of the bladder having been folded into the skid such that the entire bladder is secured within the skid between the first panel and base members.

Although in the embodiment of FIGS. 11 through 21 bladder 12 is fixed or otherwise secured to at least the upper portion 54 of first panel member 51, it is expected that in most instances the bladder will also be secured or otherwise fastened to the lower portion 56 of the first panel member. In most instances it is anticipated that first panel member 51 will include at its lower end 56 manifold assembly 57 providing fluid communication with the interior of bladder 12. That is, manifold assembly 57 may have one or more ports to which pipes, hoses or supply lines can be secured for purposes of filling, evacuating, venting or cleaning the interior of bladder 12. Further, in the particular embodiment shown, the upper portion 54 of first panel member 51 includes a pair of venting connections 58 that are in fluid communication with the interior of bladder 12 when the containment system is assembled. Venting connections 58 provide a means for fluids, air, or other gas that may be retained within bladder 12 to escape or be vented off as the bladder is filled through manifold 57.

Venting connections 58 also provide for the potential to top-fill the bladder.

As shown more specifically in FIG. 18, in the particular embodiment depicted, venting connections 58 are each in communication with a vent tube 59 extending along the length of first panel member 51 and terminating at or near manifold 57. In this manner all exterior connections to the containment system can be made at the same general location.

The vent tube can thus easily be connected to remote piping or hoses in order to collect and potentially process vented fluid, particularly in cases where fluid vented from the bladder may be toxic or combustible. If desired, first panel member 51 may also include one or more level indicator tubes 60 having their respective ends in communication with the interior bladder 12.

The level indicates tubes may be at least partially transparent or translucent such that they provide a visual indication of the level of the contents retained within the bladder. There are, of course, many other forms of level indicators that could equally be utilized in order to provide an operator with an indication of the level of the contents stored within bladder 12.

It will be understood by one of ordinary skill in the art having a thorough understanding of the invention that the embodiment shown in FIGS. 11 through 21, provides a means for the efficient storage, transport and assembly of a containment system by virtue of a skid 20 having a first panel member 51 which has secured or otherwise fixed to at least the upper portion thereof a bladder 12. In this way, as the first panel member is rotated from a storage position (where it is generally parallel and adjacent to the base 50 of the skid) to a generally vertical orientation the bladder is simultaneously deployed and pulled upwardly to the top of what will ultimately be a portion of the support structure for the containment system. Such a structure removes the need to physically place the bladder within an assembled containment system, to locate the bladder at the proper position within the containment system, and to subsequently unfold the bladder to allow it to be properly and effectively filled to its normal capacity. In the case of the embodiment shown in FIGS. 11 through 21, the rotation of the first panel member effectively deploys the bladder to a position that it can be readily filled without the risk of the bladder becoming entangled or otherwise knotted with itself, thereby preventing an inefficient filling of the bladder and possibly adding excessive strain to portions of the bladder. The described structure also ensures that the bladder is pre-secured to venting connections and fill manifolds within first panel member 51, thereby eliminating the need to make connections in the field and hence reducing assembly time and labour. The set-off of the first panel member from base 50 of skid 20 when in its folded state, presents a convenient void within which the bladder can be stored safely, securely and out of harm's way. In addition, and as described above, disassembly of the containment system is simplified in that there is no need to "decouple" the bladder from the containment system. The only requirements are that any external venting or fill lines be disconnected from first panel member 51 as the connections to the bladder itself will remain intact.

Cleaning and servicing the bladder is also enhanced through the described structure. In the case of a bladder that has been evacuated that requires cleaning, cleaning fluid can be injected into the bladder through manifold 57 and/or venting connections 58.

With a portion of the bladder retained on the upper portion 54 of the first panel member, the bladder will be held in at least a partially deployed state, enhancing the ability for cleaning fluid injected into the bladder so that it contacts all interior surfaces. In traditional bladder containment systems, the bladder is not retained at the upper portion of the support structure such that when the bladder is evacuated it slumps or folds over upon itself within the interior of the support structured, thereby making it difficult for cleaning solution to contact all of the interior bladder surfaces.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements. The scope of the claims should not be limited by the illustrated embodiments set forth as examples, but should be given the broadest interpretation consistent with a purposive construction of the claims in view of the description as a whole carriage return.

The invention claimed is:

1. A containment system comprising: a flexible bladder having at least one opening through which a liquid or other fluid or material can be pumped or otherwise transferred into or out of the bladder, the bladder having a contracted state where the contents of the bladder are substantially evacuated and having an expanded or semi-expanded state where the bladder is filled or partially filled with a liquid or other fluid or material; a support structure that surrounds the bladder and provides lateral support to the bladder when the bladder is in said expanded or semi-expanded state, the support structure comprising a plurality of panels that are separably connectable to one another to form an enclosed walled support structure, the at least one opening in the bladder operatively connected to a point exterior to the support structure to permit the bladder to be filled or evacuated from a position exterior to the support structure; a skid having a first portion and a second portion, the skid underlying at least one of the plurality of panels of the support structure such that the first portion of the skid is positioned within the enclosed walled support structure and the second portion of the skid is positioned outside the enclosed walled support structure, the bladder secured to the first portion of the skid and positioned within the enclosed walled support structure, the skid further including at least one conduit having a first end terminating at the first portion of the skid and in communication with the at least one opening through the bladder, the conduit having a second end terminating at the second portion of the skid and positioned outside the enclosed walled support structure, the conduit permitting the bladder to be filled or evacuated from a position exterior to the enclosed walled support structure; and wherein the bladder is received and stored in a folded state on the skid for transport, the skid having side walls and a bottom panel to form a shipping container for protection of the bladder during transport, the side walls hingedly or releasably secured to the bottom panel to permit the side walls to be removed or folded downwardly for deployment of the bladder.

2. A containment system comprising:

a flexible bladder having at least one opening through which a liquid or other fluid or material can be pumped or otherwise transferred into or out of the bladder, the bladder having a contracted state where the contents of the bladder are substantially evacuated and having an expanded or semi-expanded state where the bladder is filled or partially filled with a liquid or other fluid or material, and a support structure that surrounds the bladder and provides lateral support to the bladder when the bladder is in said expanded or semi-expanded state, the support structure comprising a plurality of panels that are separably connected to one another to form an enclosed walled support structure, the at least one opening in the bladder operatively connected to a point exterior to the support structure to permit the bladder to be filled or evacuated from a position exterior to the support structure;

wherein the bladder is received and stored in a folded state on a skid for transport, the skid having side walls and a bottom panel to form a shipping container for protection of the bladder during transport, the side walls hingedly or releasably secured to the bottom panel to permit the side walls to be removed or folded downwardly for deployment of the bladder;

and further wherein the skid includes a plurality of conduits having first ends, each in fluid communication with separate openings through the bladder, and having second ends, each terminating exterior to the enclosed walled support structure.

* * * * *